US005873601A

United States Patent [19]

Peleman

[11] Patent Number: 5,873,601

[45] **Date of Patent: *Feb. 23, 1999**

[54] BINDING ELEMENT FOR SHEETS

[75] Inventor: Guido Peleman, 2018 Antwerp, Belgium

[73] Assignee: Unibind (Cyprus) Limited, Nicosia, Cyprus

[ * ] Notice: This patent issued on a continued prosecution application filed under 37 CFR 1.53(d), and is subject to the twenty year patent term provisions of 35 U.S.C. 154(a)(2).

[21] Appl. No.: 579,259

[22] Filed: Dec. 27, 1995

[30] Foreign Application Priority Data

Dec. 27, 1994 [BE] Belgium ..... 09401170

[51] Int. Cl.[6] ..... B42D 1/00

[52] U.S. Cl. ..... 281/21.1; 412/36

[58] Field of Search ..... 281/21.1, 23, 24, 281/28, 29, 35–37, 15.1, 20; 412/1, 4, 5, 6, 8, 38, 34, 33, 35, 36

[56] References Cited

U.S. PATENT DOCUMENTS

| | | | |
|---|---|---|---|
| 1,194,742 | 8/1916 | Johnson | 281/15.1 |
| 3,188,114 | 6/1965 | O'Brien et al. | 281/21.1 |
| 4,575,123 | 3/1986 | Giblin et al. | 412/34 |
| 5,066,182 | 11/1991 | Stonebreaker et al. | 281/36 |
| 5,078,563 | 1/1992 | Lolli | 412/8 |
| 5,425,554 | 6/1995 | Lamanna | 281/21.1 |

FOREIGN PATENT DOCUMENTS

| | | | |
|---|---|---|---|
| 1006292 | 7/1994 | Belgium . | |
| 15 37906 | 7/1968 | France | 281/29 |
| 2359985 | 6/1975 | Germany | 281/29 |
| 3811133 | 9/1989 | Germany | 281/35 |
| 365702 | 1/1963 | Switzerland . | |
| 1675120 | 9/1991 | U.S.S.R. | 412/1 |

OTHER PUBLICATIONS

Webster's New International Dictionary, 2nd Ed. –p. 1358–Definitions of "kerf", Sep. 1940.

Miller's Office Products–From the Examiner's reference collection–p. 605, Dec. 1989.

*Primary Examiner*—Willmon Fridie, Jr.

*Attorney, Agent, or Firm*—Bacon & Thomas

[57] ABSTRACT

A binding element for sheets includes a back which is provided on the inside with an amount of glue which melts under the influence of heat. The back includes, on the one hand, a U-shaped element made of rigid material and, on the other hand, a cover strip which is connected directly or indirectly at one longitudinal edge thereof to the U-shaped element, and further is folded around the U-shaped element at another longitudinal edge thereof.

8 Claims, 2 Drawing Sheets

Fig. 1
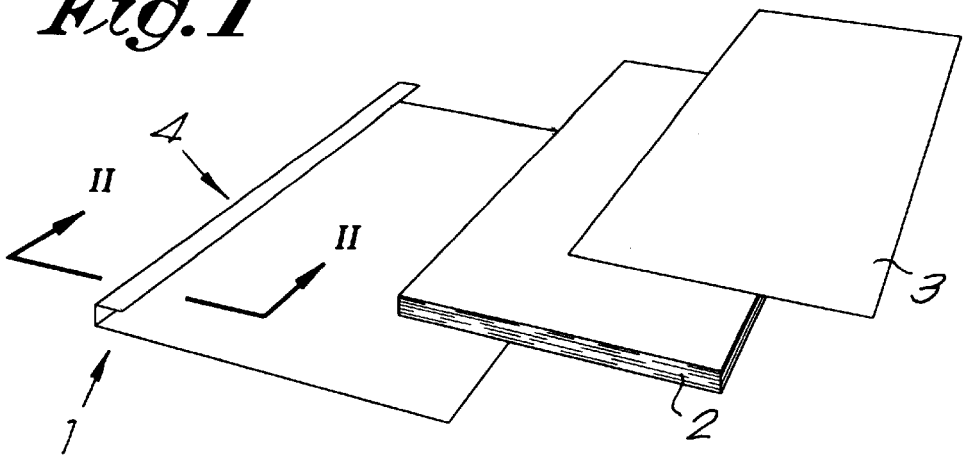
Fig. 3
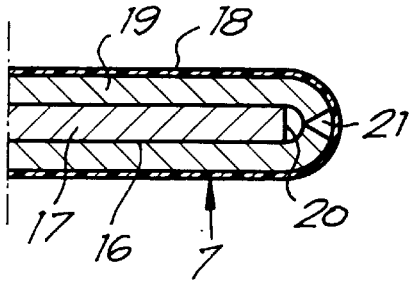
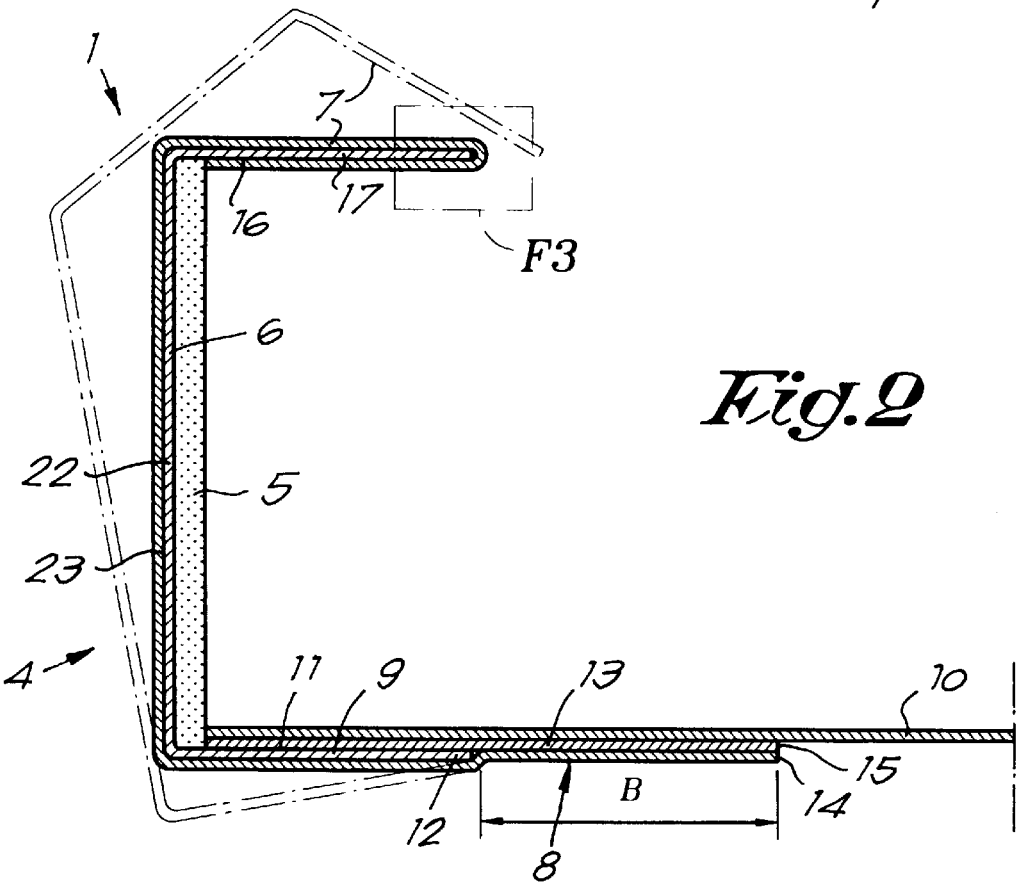
Fig. 2

BINDING ELEMENT FOR SHEETS

BACKGROUND OF THE INVENTION

1. Field of the Invention

The present invention concerns a binding element for sheets of the type which consists of at least a back which is provided on the inside with an amount of glue which melts under the influence of heat.

2. Discussion of the Prior Art

Binding elements of the above-mentioned type are generally known.

In order to bind a bundle of sheets or documents by means of such a binding element, these sheets are brought in contact with the glue in the binding element. Subsequently, the whole is put vertically, with the back downward, on a heating element, so that the glue melts and the sheets penetrate in the glue. After the binding element has been removed from the heating element, the glue solidifies, which has for a consequence that the sheets are held in the binding element by means of the glue.

Various sorts of such binding elements are already known. Often, they are composed of several components which are mutually attached to one another, including components whose aim it is to form at least a back, as well as components, such as cover strips, whose aim it is to lend an aesthetic character to the binding element.

In the known embodiments, these components are mutually attached to one another in a rather complex manner, by which is meant that several connections must be made, which results in a relatively high production cost, on the one hand because several appliances are required to realize the connections between the components, and on the other hand because the production time is lengthy, due to the large number of operations to be carried out.

SUMMARY OF THE INVENTION

The present invention is directed to a binding element which can be made in a relatively simple manner and whereby use is made of a cover strip whose application only requires a small production cost.

To this end, the invention concerns a binding element for sheets of the type which consists of at least a back which is provided on the inside with an amount of glue which melts under the influence of heat, characterized in that the back at least consists of, on the one hand, a U-shaped element made of rigid material and, on the other hand, a cover strip which is connected directly or indirectly at one longitudinal edge thereof to the above-mentioned element, and further is folded freely around this element.

Due to the fact that use is made of a U-shaped element made of rigid material, the cover strip, after it has been folded around said element, stays in place, although it is only attached at one edge, so that the number of production stages can be restricted to a minimum.

BRIEF DESCRIPTION OF THE DRAWINGS

In order to better explain the characteristics of the invention, the following preferred embodiments are described as an example only without being limitative in any way, with reference to the accompanying drawings, in which:

FIG. 1 shows a binding element according to the invention, as well as a bundle of documents which can be bound by means of this binding element;

FIG. 2 represents a section to a larger scale according to line II—II in FIG. 1;

FIG. 3 represents a view to a larger scale of the part which is indicated in FIG. 2 with F3;

DETAILED DESCRIPTION OF THE PREFERRED EMBODIMENTS

Figure 4:
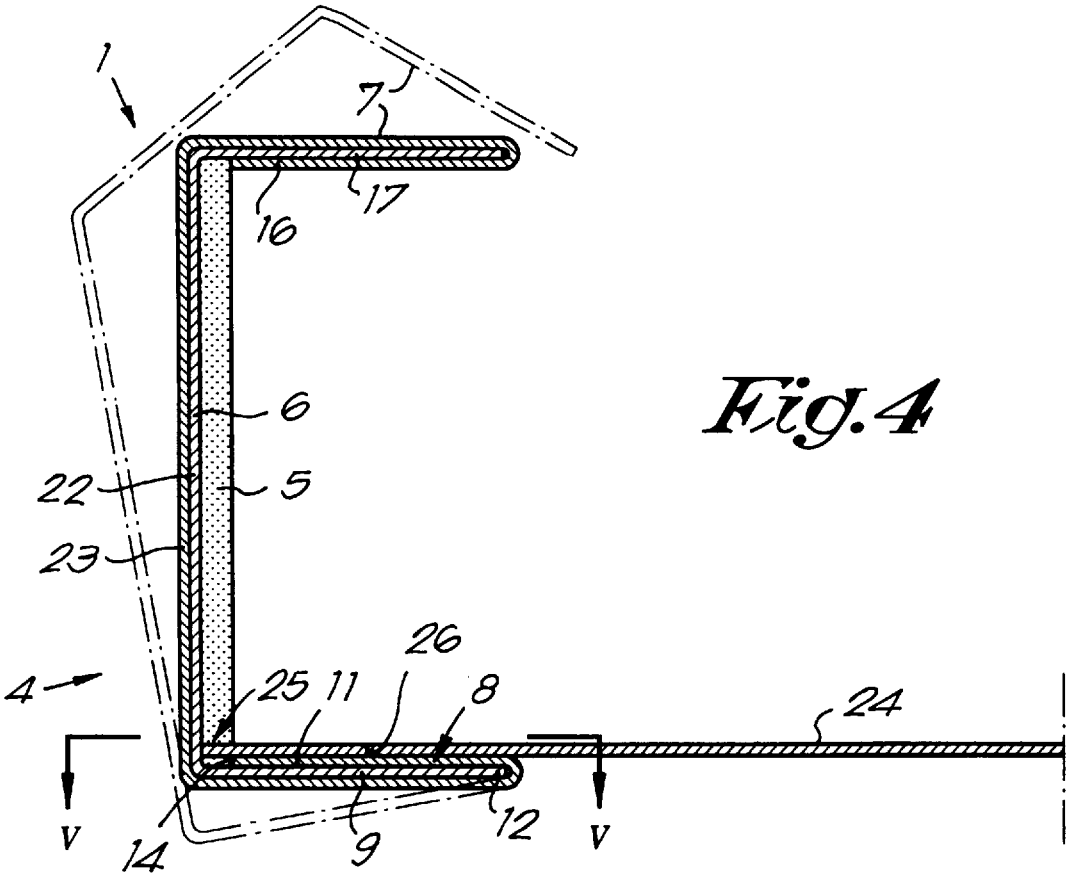
FIG. 4 shows a variant of a binding element according to the invention.

As represented in FIG. 1, the invention concerns a binding element 1 which is meant to be used for binding sheets or documents, in this case a bundle of sheets 2 and a front sheet 3 inserted before it.

As represented in FIG. 2, the invention in particular concerns a binding element 1 of the type which consists at least of a back 4 which is provided on the inside with an amount of glue 5 which melts under the influence of heat.

The invention is special in that the back 4 consists at least of, on the one hand, an element 6 made of rigid material and with a U-shaped section, and on the other hand, a cover strip 7 which is connected at one longitudinal edge 8 thereof, preferably over a certain width B, either directly or indirectly to the above-mentioned element 6 and further is folded freely around this element 6.

In particular, the cover strip 7 is preferably connected to the element 6 at one leg 9 of this U-shaped element 6.

This makes it possible for the cover strip 7 to be provided around the element 6 in one single movement, which can be easily done in one production stage.

According to the most preferred embodiment, as represented in FIG. 2, the connection between the U-shaped element 6 and the cover strip 7 is made by attaching an indirect connection which includes a material layer, which in this case is formed of a sheet 10, against the inner side 11 of the above-mentioned leg 9 and by attaching the cover strip 7 in turn at its edge 8 against the material layer, right next to the free end 12 of the above-mentioned leg 9 thereby effectively enclosing at least in part leg 9 between the sheet 10 and edge 8, with only material 10 directly connected to element 6.

The connection between the leg 9 and the above-mentioned material layer on the one hand, i.e. the sheet 10, and said material layer and the cover strip 7 on the other hand, is preferably realized by means of one single strip of double-adhesive tape 13 which lies partly against the inner side 11 of the leg 9 and which partly reaches past the free end 12 of the leg 9. In order to obtain a good attachment, the adhesive tape 13 preferably extends in the width over the entire inner side 11 and the side edge 14 of the longitudinal edge 8 coincides precisely with the side edge 15 of the adhesive tape 13.

Although, in order to limit the production costs, preferably one single continuous strip of double-adhesive tape 13 is used, it is not excluded according to the invention to use several strips, for example separate strips between the leg 9 and the sheet 10 on the one hand, and between the sheet 10 and the cover strip 7 on the other hand, or to use other bonding techniques.

As already explained, the above-mentioned material layer preferably consists of a sheet 10. In particular, this sheet 10 can be a back sheet, as represented in FIG. 1.

The cover strip 7 is preferably at least so wide that, when it is folded around the element 6, it lies at least up against the inner side 16 of the second leg 17 of the U-shaped element 6. Preferably, the cover strip 7 even extends thus far that it covers the entire or almost the entire inner side 16.

As represented in FIG. 3, the cover strip 7 may consist of a top or outer layer 18 made of plastic and a thicker bottom or inner layer 19 which is provided with a folding edge 21 at least where the cover strip 7 is folded around the free longitudinal end 20 of the leg 17. The bottom layer 19 preferably consists of paper, whereas the top layer 18 can be made of a coat of synthetic material provided on the paper. The folding edge 21 may consist of an incision in the bottom layer 19, or it can be formed in that this bottom layer 19 is formed of several strips provided next to one another.

It is clear that folding edges, such as folds, incisions or such can possibly be provided in the folding strip 7 at the height of the angles of the U-shaped element 6.

The top layer 18 can be made in various colors.

The U-shaped element 6 preferably has a rectangular U-shape, in other words includes of a flat back part 22 and also flat legs 9 and 17 situated at right angles to it. However, the transitions at the angles can be slightly rounded off.

Naturally, it is not excluded to choose another U-shape, for example with a bent back part 22 and/or with legs 9 and 17 which are slightly angled toward one another, such that the package of sheets 2–3 can be clamped elastically.

The element 6 is preferably made of metal, for example steel. It is clear, however, that also other materials which are sufficiently rigid can be used to this end, such as a hard plastic or such. However, preference is given to a metal, as it ensures an optimal heat transfer during the binding between the heat element of the binding equipment used and the glue 5.

It should be noted that, due to the fact that the cover strip 7 is placed against the back part 21 without any glue or such, the heat transfer is minimally impeded, in particular because the heat only has to go through the thin cover strip 7 to reach the element 6, which preferably conducts heat well.

However, it is not excluded according to the invention to apply a covering or such that incorporates glue G which will melt under the influence of the heat during the binding and which will form an adhesion after heating then cooling down against the inner side of the cover strip 7 and/or against the outside 23 of the back part 22. Indeed, the fact that a cover strip 7 or an element 6 is used which, as is mentioned above, is covered with a layer of thermally activated glue, does not hinder the production process in any way, as there is no connection between the element 6 and the cover strip 7 until the moment when the binding element will be applied and heated in a binding appliance, to the exception of the strip of double-adhesive tape 13 or such which is used according to the invention.

According to a variant, the cover strip 7 can be transparent or show transparent parts, such that between this strip and the element 6 can be added a band with an inscription or such. It is not excluded to provide more coverings around the cover strip 7.

It is clear that a binding element 1 as represented in FIG. 2 can be composed with a minimum of production stages, for example by first fixing the adhesive tape 13 on the sheet 10, by subsequently fixing the sheet 10 against the inner side 11 of the first leg 9 by means of the adhesive tape 13 and by finally pressing the cover strip 7 against the part of the adhesive tape 13 which remains free and by applying it with its free part, as represented by means of a dashed line in FIG. 2, around the element 6, by folding it respectively.

The use of the binding element 1 is made clear in FIG. 1. Normally, the bundle of sheets 2 to be bound will be put, either or not with a front sheet 3, in the U-shape, and the whole is heated in a binding equipment with the back 4 downward, so that the sheets 2–3 sink in the glue 5 and remain stuck in the binding element 1 after said glue 5 has solidified. It is clear that the free part of the cover strip 7 becomes clamped between the second leg 17 of the U-shaped element 6 and the bound sheets 2–3, so that it is impossible for this strip to come loose.

As represented in the variant of FIG. 4, the cover strip 7 can be folded around the end of the first leg 9 of the U-shaped element 6.

Hereby, the connection between the U-shaped element 6 and the cover strip 7 is preferably formed by the part of the cover strip 7 which is folded around the end of the first leg 9 of the U-shaped element 6, whereby this part is caught to this end between the above-mentioned first leg 9 and a sheet 24 fixed to the back 4. The sheet 24 can hereby be attached to the back 4 by means of the above-mentioned glue 5. The adhesion of the sheet 24 can be optimized by providing it with a notched edge 25, as represented in FIG. 5.

It is clear that the cover strip 7 is held in place because it is stuck with its longitudinal edge 8 between the sheet 24 and the leg 9. Adhesive means for the cover strip 7, such as the above-mentioned adhesive tape 13, are not necessary. The side edge 14 can possibly be embedded in the glue 5.

Figure 5:
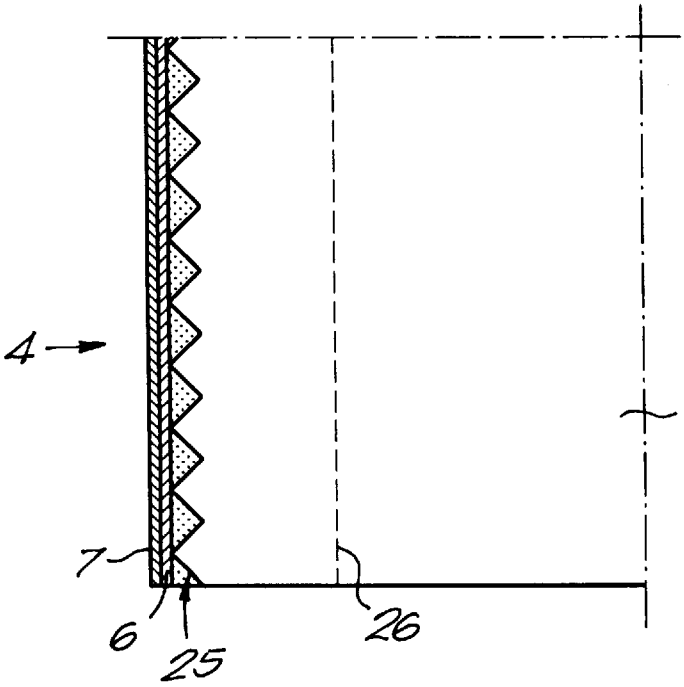
FIG. 5 shows a section according to line V—V in FIG. 4.

In the example represented in FIGS. 4 and 5, the sheet 24 is provided with a tear line 26 at the height of the back 4, which is for example formed of perforations. This tear line 26 makes it possible to practically entirely remove the sheet 24 after the binding of the bundle 2. The sheet 24 in this case merely aims to simplify the binding.

It is clear that the tear line 26 is preferably situated inside the U-shape of the element 6.

The present invention is by no means limited to the embodiments described above and represented in the accompanying drawings; on the contrary, such a binding element can be made in various forms and dimensions while still remaining within the scope of the invention.

I claim:

1. A binding element for securing a binder of sheets together comprising:

a generally U-shaped first element made of rigid material and including first and second leg portions that are interconnected by a back portion, said back and leg portions having inner and outer sides;

a quantity of heat activatable glue provided on the inner side of the back portion of said first element;

a cover member covering the outer sides of said first and second leg portions and said back portion of said first element, said cover member including a first longitudinal end portion located adjacent said first leg portion of said first element;

a fastener arrangement securing the first longitudinal end portion of the cover member adjacent said first leg portion of said first element;

the remainder of said cover member being freely wrapped over the outer sides of said leg portions and back portion of said first element by freely folding of same without securing devices connecting the remainder of the cover member to the first element;

said first element and said cover member defining a back part of said binding element arranged to receive a bundle of sheets to be retained therein by said amount of glue.

2. The binding element according to claim 1, said second leg portion including a longitudinal free end, and wherein said cover member extends around the second leg portion of said first element, over a longitudinal free end thereof and over at least a portion of the inner side of said second leg portion.

3. The binding element according to claim 1, wherein said cover member comprises an outer layer made of synthetic material and an inner layer which is thicker than said outer layer, said inner layer being provided with a folding edge located directly adjacent said longitudinal free end of the second leg portion of said first element.

4. The binding element according to claim 1, said first leg portion including a longitudinal free end, and said fastener arrangement comprising a material layer including first and second adjacent and continuous sections;

the first section of said material layer secured to the inner side of said first leg portion; the second section of said material layer extending away from said longitudinal free end of said first leg portion;

said second section of said material layer being secured to said first longitudinal end portion of said cover member adjacent said longitudinal free end of said first leg portion;

said longitudinal free end of said first leg portion enclosed by said material layer and the longitudinal end portion of said cover member.

5. The binding element according to claim 4, said material layer comprising double sided adhesive tape.

6. The binding element according to claim 1, wherein said first leg portion includes a longitudinal free end, and said fastening arrangement comprises a material layer;

said longitudinal end portion of said cover member being folded over said first leg portion around said longitudinal free end and over the inner side of said first leg portion;

said material layer including an inner longitudinal end overlying and contiguous with said longitudinal free end of said cover member, said inner longitudinal end secured to said first element by said heat activatable glue;

said sheet material layer extending away from said first leg portion of said first element in a direction away from said back portion and forming a back sheet of said binding element.

7. The binding element according to claim 6, wherein said sheet material layer is provided with a pre-formed tear line extending along said first leg portion of said first element.

8. The binding element according to claim 1, further comprising a layer of inactivated hot melt glue disposed between said cover member and the back portion of said first element.

* * * * *